US006390829B1

(12) United States Patent
Rademacher

(10) Patent No.: US 6,390,829 B1
(45) Date of Patent: May 21, 2002

(54) ELECTRICAL CONNECTOR ASSEMBLY FOR A PRINTED CIRCUIT BOARD

(75) Inventor: William A. Rademacher, El Paso, TX (US)

(73) Assignee: Antec Corporation, Duluth, GA (US)

( * ) Notice: Subject to any disclaimer, the term of this patent is extended or adjusted under 35 U.S.C. 154(b) by 0 days.

(21) Appl. No.: 09/841,822

(22) Filed: Apr. 25, 2001

Related U.S. Application Data

(60) Provisional application No. 60/199,568, filed on Apr. 25, 2000.

(51) Int. Cl.[7] ..... H01R 12/00

(52) U.S. Cl. ..... 439/74; 439/63; 439/771; 439/810; 174/138 G

(58) Field of Search ..... 439/63, 74, 75, 439/771, 810, 78, 814; 174/138 G

(56) References Cited

U.S. PATENT DOCUMENTS 4,795,352 A * 1/1989 Capp et al. ..... 439/63
4,917,615 A * 4/1990 Franks, Jr. ..... 439/98
5,769,645 A * 6/1998 Martin et al. ..... 439/79
5,772,452 A * 6/1998 Aoyama ..... 439/74
5,957,733 A * 9/1999 Mello et al. ..... 439/814
6,123,551 A * 9/2000 Westfall ..... 439/67
6,213,818 B1 * 4/2001 Chadbourne ..... 439/810
6,280,202 B1 * 8/2001 Alden, 3rd et al. ..... 439/66

* cited by examiner

*Primary Examiner*—Tho D. Ta
*Assistant Examiner*—Truc Nguyen
(74) *Attorney, Agent, or Firm*—Troutman Sanders LLP

(57) ABSTRACT

The present invention relates to an electrical connector assembly for a printed circuit board which alleviates the need to remove stingers from the assembly when removing the printed circuit board. The assembly of the present invention comprises a male connector for receiving one or more stingers. The stinger, which is located at the end of a cable such as a coaxial cable, forms an electrical circuit within the male connector. The male connector is inserted within a female connector coupled to a printed circuit board, forming an electrical connection. If the printed circuit board is removed from the assembly, the female connector is disconnected from the male connector enabling the stinger to be maintained in place with the male connector easing the replacement operation.

2 Claims, 3 Drawing Sheets

ELECTRICAL CONNECTOR ASSEMBLY FOR A PRINTED CIRCUIT BOARD

CROSS REFERENCE TO RELATED APPLICATION

This application claims priority on U.S. Provisional Patent Application Serial No. 60/199,568 filed Apr. 25, 2000, now pending.

FIELD OF INVENTION

This invention relates generally to connectors, and, more particularly, to an electrical connector assembly for allowing the removal of a printed circuit board without first having to remove the stingers from the printed circuit board.

BACKGROUND

Printed circuit boards used in a network setting frequently must be removed for repair or for replacing various components. Because designs in the prior art require a direct interconnection between the stinger and the printed circuit board, these designs frequently require removing the stingers before removing the printed circuit board may be removed. However, this process is burdensome because of the added time required for removing the stingers, and possibly other components. Furthermore, removing the stingers every time the printed circuit board must be moved places additional wear on the connection.

Thus, the ability to remove or repair a printed circuit board without having to remove the stinger is desirable because otherwise, any repairs made to the printed circuit board would result in having to first remove any stingers which requires additional time. Therefore, there is a need in the art for a system which allows a printed circuit board to be easily removed without having to first remove the stinger from the assembly.

SUMMARY OF THE INVENTION

The present invention overcomes the above-described problems in the prior art by providing an electrical connector assembly which provides for the easy removal of the printed circuit board without having to first remove the stingers. The assembly comprises a female connector which is fixably mounted on a first printed circuit board, comprising an electrically conductive body defining an interior, and having a first and second end. The female connector has printed circuit contacts coupled to the second end for making contact with the printed circuit board. The present invention further comprises a male connector comprising an electrically conductive body defining a general profile for being mated with the female connector, and which also includes a stinger conduit for making electrical contact with a stinger. Overall, the assembly of the present invention overcomes the disadvantages in the prior art by allowing the printed circuit board to be removed from said assembly without having to first remove the stinger from the male connector.

DETAILED DESCRIPTION

Figures 1, 2:
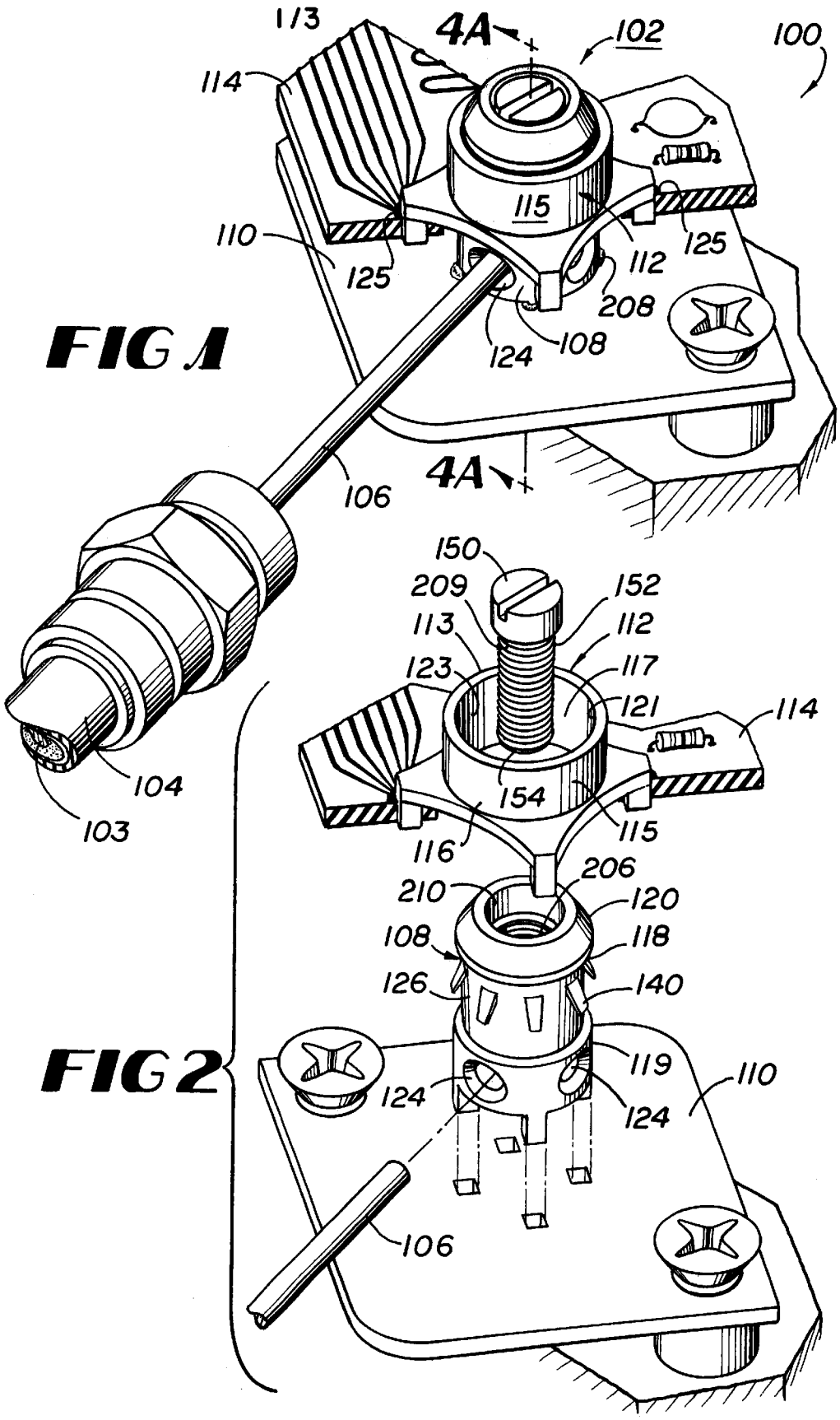
FIG. 1 is a high level diagram that illustrates the exemplary environment suitable for the preferred embodiment of the present invention.
FIG. 2 is an exploded view of the various components utilized in the assembly of the present invention.

Referring now in detail to the drawings in which like numerals refer to like parts throughout the several views, as shown in the illustration of FIG. 1, the electrical connector assembly in the preferred embodiment is adapted for use with a printed circuit board to maintain the integrity of the electrical connection between the stinger and the assembly. However, those skilled in the art will recognize that the present invention may be utilized in other environments involving an electrical connection between an assembly and a stinger where the integrity of the connection should be maintained during removal of a surface.

FIG. 1 is a high level diagram that illustrates the exemplary environment 100 suitable for the preferred embodiment of the present invention. A shielded cable 104 which carries data is used for interconnection with electrical connector assembly 102. Shielded cable includes a conductor 103 having an exposed electrically conductive end referred to herein as a stinger 106. Stinger 106 enters the electrical connector assembly 102 through a male connector 108 connected to a second board 110. The second board 110 may be a printed circuit board, or any other horizontal surface capable of supporting the male connector. This male connector 108 is releasably attached in electrical connection with a female connector 112, which is fixably mounted onto a first printed circuit board 114. The stinger is connected in electrical connection with male connector 108, forming an electrical connection between stinger 106 and female connector 112.

FIG. 2 is an exploded view of the various components utilized in the assembly of the present invention. As illustrated in FIG. 2, the electrical connector assembly includes a male connector 108 and a female connector 112 used in conjunction with a first printed circuit board 114 and a second board 110.

Female connector 112 is adapted for being fixably mounted onto printed circuit board 114. Female connector 112 has an electrically conductive body 115 which defines a general profile. Female connector body 115 includes a female connector inner wall 123 which defines a female connector interior 117. Female connector body 115 also includes a first end 113 and a second end 116. First end 113 defines an opening 121 into female connector interior 117 which enables male connector 108 to be received into female connector interior 117. Printed circuit board contacts 125 are carried by second end 116 for engaging circuits of a first printed circuit board 114. Preferably printed circuit board contacts 125 are soldered to circuits of a first printed circuit board 114.

The female connector 112 is fixably mounted to the first printed circuit board 114 over a throughhole (not shown) located in the first printed circuit board 114, enabling the male connector 108 to be inserted into the throughhole and female connector interior 117.

Male connector 108 has a male connector body 120 which includes an outer wall 126 defining a male connector interior 206. Outer wall 126 defines stinger aperature 124 for receiving stinger 106. Stinger aperature 124 communicates with male connector interior 206. Male connector body 120 consists of an upper portion 118 and a lower portion 119. Male connector 108 may be a unitary piece or composed of two separate pieces. The lower portion 119 of the male connector 108 includes board contacts 208 for stabilizing the male connector on a second board 110. In the preferred embodiment, board contacts 208 are a set of legs. However, the board contacts 208 may be any other form of support suitable for stabilizing the male connector 108 on the second board 110.

Female connector contacts 140 are carried by the upper portion 118 of male connector 108. Female connector contacts 140 extend outward beyond the profile of male connector body 120 and are of metal or other electrical conductive material. Preferably, female connector contacts 140 are tabs biased to protrude outward away from the upper portion 118. Alternatively, female connector contacts 140 may be tapered bosses. Upper portion 118 of male connector 108 has a diameter smaller than female connector interior 117 enabling the upper portion of male connector 108 to be received through opening 121 into female connector interior 117. When the upper portion 118 of male connector 108 is received within female connector interior 117, female connector contacts 140 engage female connector inner wall 123 establishing electrical connection between male connector 108 and female connector 112.

Stinger conduit 150 is utilized to electrically connect stinger 106 with female connector contacts 140. In one embodiment, stinger conduit is merely the outer wall of the male connector. In this embodiment, the outer wall of the male connector is metal or other electrical conductive material. As stinger 106 is received within stinger aperture 124, stinger aperture 124 is of a size which enables stinger 106 to engage the outer wall of the male connector. Or in the alternative, a metallic contact is positioned within stinger aperture 124 for electrically communicating stinger 106 with the outer wall of male connector 126.

In an alternative embodiment, male connector interior 206 is adapted for receiving stinger conduit 150. Stinger conduit 150 includes a first end 154 which engages stinger 106 within the male connector interior 206 and a second end 152 which is in electrical connection with female connector contacts 140. The upper portion of male connector 108 includes metallic contacts 209 which electrically connect the second end 152 of stinger conduit 150 with female connector contacts 140 for electrically engaging the stinger conduit. In the preferred embodiment, stinger conduit 150 is a set screw and metallic contacts 209 are metallic grooves which interact with the metallic body of male connector 108 for electrically connecting female connector contacts 140 with stinger conduit 150.

Figure 3:
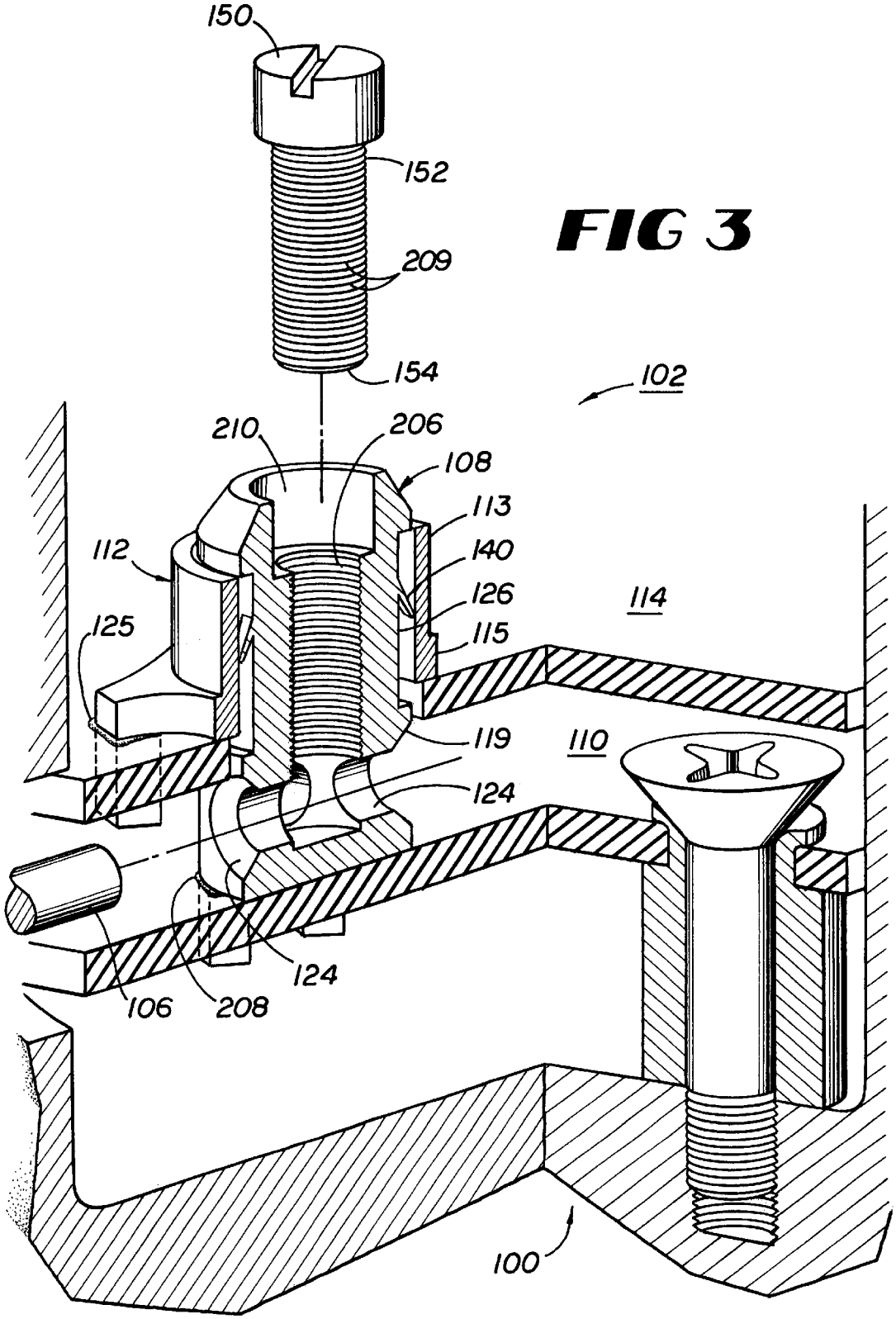
FIG. 3 is a cross-sectional diagram of the components of the present invention.

FIG. 3 is a cross-sectional diagram of the components of the present invention. The cross section of the male connector 108 illustrates the male connector interior 206 of upper portion 118 which is adapted for receiving stinger conduit 150. Stinger conduit 150 enters the male connector interior 206 via opening 210, and is secured within the male connector interior 206 by the metallic contacts 209 in the interior. The upper portion 118 makes electrical contact with the interior of the female connector 117 by the female connector contacts 140 located on the outer wall. These female connector contacts 140 protrude outward from the body the of the male connector 118 to contact the interior of the female connector 117. The biasness of the female connector contacts, or taperedness, enables the female connector 112 to slide over the male connector 108 until frictionally held in place due to the profile of the female connector contacts exceeding the diameter of female connector.

Figure 4A:
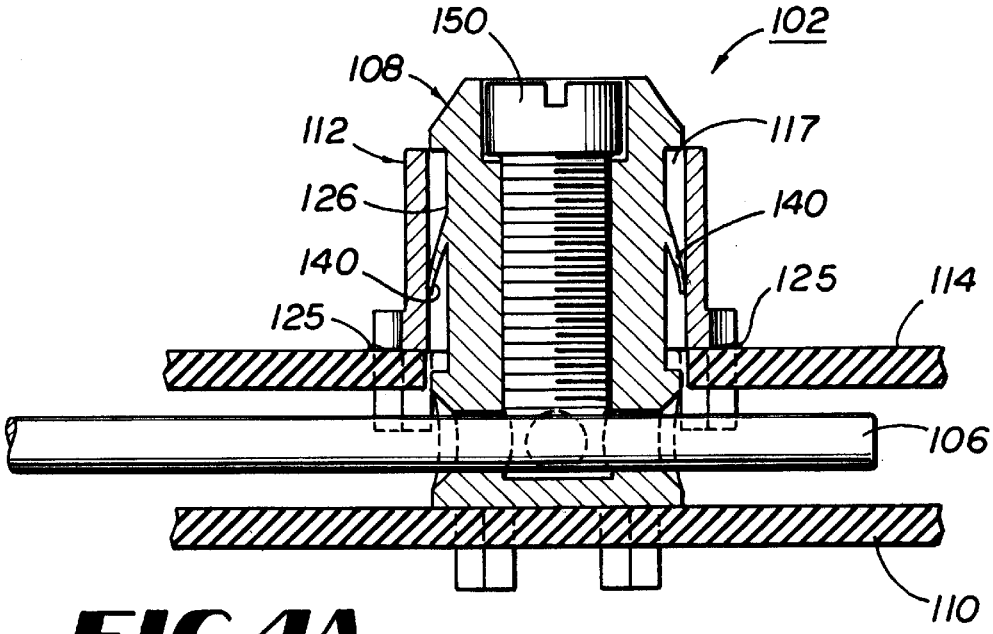
FIG. 4A is a cross-sectional diagram of the components of the present invention taken along line 4A when fully assembled.

FIG. 4A illustrates, when assembled, the electrical connector assembly establishes an electrical connection between the stinger 106 and the first printed circuit board 114. Stinger 106 enters the male connector 108 which is attached to the first printed circuit board 114 and contacts electrically conductive stinger conduit 150 which is located in the male connector 108. Since stinger conduit 150 is preferably a set screw, force is applied to hold stinger 106 in place within the assembly.

The electrical connection between the stinger 106 and stinger conduit 150 passes to the male connector 108 by the contact of the stinger conduit 150 with the metallic contacts 209 within the interior of the male connector 206. Since the body of male connector 108 is conductive, the electrical connection continues to female connector contacts 140. Electrical connection is continued with the female connector 112 by the female connector contacts 140 protruding outward from the male connector body 120 and contacting the interior of the female connector 115. Since the body of female connector is also conductive, the electrical signal from the stinger 106 passes to the printed circuit board contacts 125 and subsequently to the first printed circuit board 114.

Figure 4B:
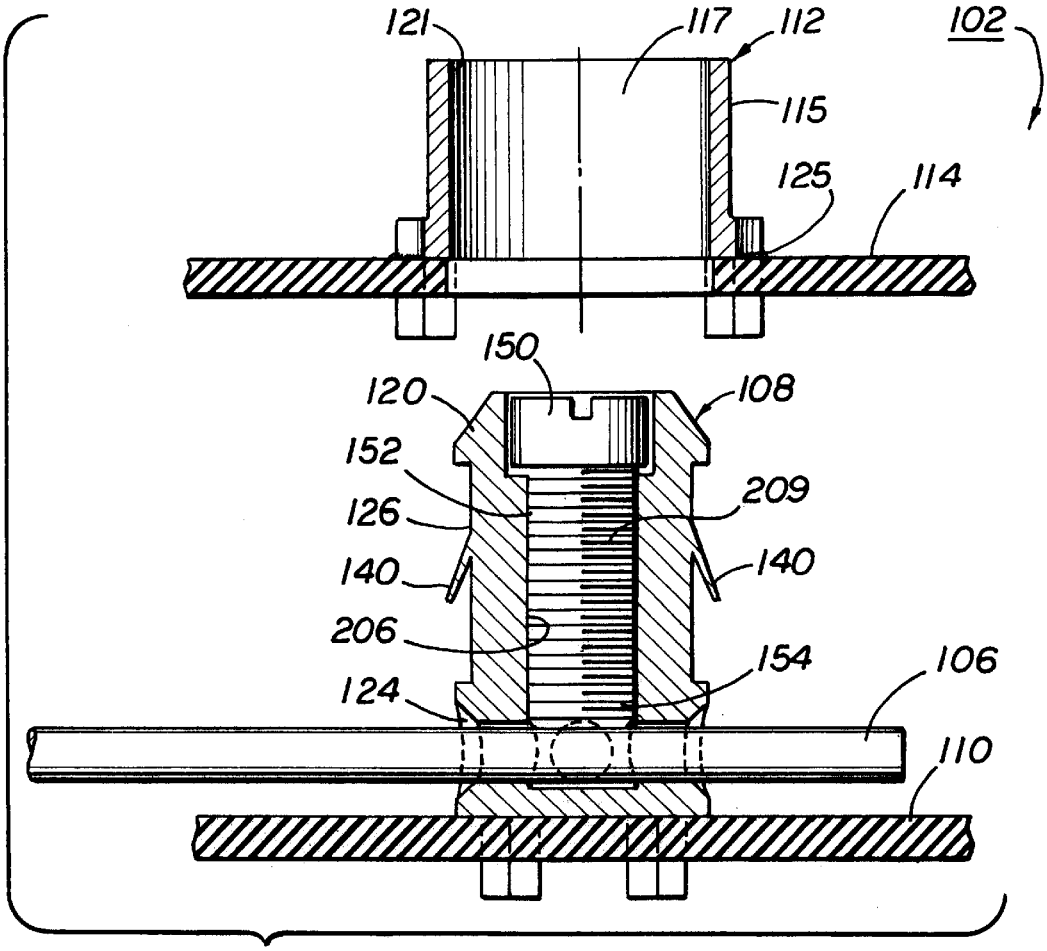
FIG. 4B is a cross-sectional diagram of the assembly of the present invention taken along line 4A in FIG. 1 after the first printed circuit board is removed.

FIG. 4B is a cross-sectional diagram of the assembly of the present invention when the first printed circuit board 114 is removed. When the first printed circuit board 114 is removed, the second board 110 containing the male 108 and female 112 connectors remain attached to the second board 110. This alleviates the need to remove the stingers 106 from the assembly, and allows the stingers 108 to remain electrically connected to the male connector which remains attached to the second board 110. Thus, removing the first printed circuit board 114 removes the female connector 112 from the assembly but preserves the stinger connection in the male connector 108, because the male connector 108 is detachably coupled to the female connector 112.

In operation, the stinger conduit 150 is electrically connected to the first printed circuit board 114 through the male 108 and female 112 connector. The stinger 106 is maintained in place with the male connector 108 at all times. When removal of the first printed circuit board 114 is required, the male 108 and female 112 connectors are disconnected and a new female connector 112 which is attached to the new first printed circuit board 114 is subsequently positioned over the male connector 108 reestablishing electrical connection between the stinger 106 and the new first printed circuit board 114.

What is claimed is:

1. An electrical connector assembly for allowing removal of a printed circuit board without removing a stinger coupled to a cable from the assembly, said assembly comprising:

a female connector for being fixably mounted to a printed circuit board, said female connector comprising:

an electrically conductive body defining an interior adapted for receiving a male connector;

said body also having a first end and a second end, and printed circuit board contacts coupled to said second end for making contact with a printed circuit board, a male connector for attachment to a second board, said male connector comprising:

an electrically conductive body having an outer surface and a profile adapted for being mated with said interior of said female connector;

said body having a stinger aperture for receiving a stinger;

an electrically conductive female connector contact carried on said outer surface of said body, said female connector contact protruding outward from said body, for making contact with said interior of said female connector, wherein said printed circuit board may be removed without breaking the electrical connection between said stinger and said male connector.

2. The assembly of claim 1, further including a stinger conduit including a first end and a second end, wherein said first end is for contacting the stinger when received within the interior of said male connector, and said second end is in electrical contact with said female connector contacts for electrically connecting the stinger with said female connector contacts.

* * * * *